US006405749B1

(12) United States Patent
Bloom et al.

(10) Patent No.: US 6,405,749 B1
(45) Date of Patent: Jun. 18, 2002

(54) QUICK INSTALL FAUCET BODY

(75) Inventors: Mark S. Bloom, Simi Valley, CA (US); Brian J. Matt, Wellesley; Steven L. Hecker, Waltham, both of MA (US)

(73) Assignee: Emhart LLC, Newark, DE (US)

( * ) Notice: Subject to any disclaimer, the term of this patent is extended or adjusted under 35 U.S.C. 154(b) by 0 days.

(21) Appl. No.: 09/617,260

(22) Filed: Jul. 14, 2000

(51) Int. Cl.[7] ..... E03C 1/04

(52) U.S. Cl. ..... 137/359; 4/676; 137/606; 137/801; 285/193

(58) Field of Search ..... 4/676; 137/359, 137/606, 801; 285/193

(56) References Cited

U.S. PATENT DOCUMENTS

| | | | |
|---|---|---|---|
| 3,010,474 | A | 11/1961 | Moen |
| 3,785,396 | A | 1/1974 | Morris et al. |
| 3,790,966 | A | 2/1974 | Keane |
| 4,005,883 | A | 2/1977 | Guest |
| 4,281,857 | A | 8/1981 | Randall |
| 4,553,277 | A | 11/1985 | Duncan |
| 4,654,900 | A | 4/1987 | McGhee |
| 4,671,316 | A | 6/1987 | Botnick |
| 4,760,861 | A | 8/1988 | Botnick |
| 4,762,143 | A | 8/1988 | Botnick |
| 4,848,395 | A | 7/1989 | Krippendorf |
| 4,852,192 | A | 8/1989 | Viegener |
| 4,998,555 | A | 3/1991 | Barhydt, Sr. et al. |
| 5,127,427 | A | 7/1992 | Kajpust et al. |
| 5,232,008 | A | 8/1993 | Jeffress et al. |
| 5,388,287 | A | 2/1995 | Tischler et al. |
| 5,465,749 | A | 11/1995 | Sauter et al. |
| 5,515,882 | A | 5/1996 | Hennis |
| 5,584,513 | A | 12/1996 | Sweeny et al. |
| 5,946,746 | A | 9/1999 | Bloom |

FOREIGN PATENT DOCUMENTS

| | | |
|---|---|---|
| EP | 0213656 A1 | 11/1987 |
| FR | 2 525 296 | 10/1983 |

*Primary Examiner*—Gerald A. Michalsky
(74) *Attorney, Agent, or Firm*—Harness, Dickey & Pierce, P.L.C.

(57) ABSTRACT

An apparatus is provided for installing a faucet or end body valve assembly on a top side of a deck. The apparatus includes a threaded member engaged with the faucet or end body and extending through the mounting hole to be rotated from above the deck. A wedge nut is threadedly connected to the threaded member to pass through the mounting hole to the underside of the deck. A second member associated with and parallel to the threaded member engages the nut to prevent rotation thereof during rotation of the threaded member whereby the nut will be shifted up or down along the length of the threaded member responsive to the direction of rotation of the threaded member. A retainer member is disposed around the threaded member and includes a plurality of legs which each include a foot portion at an end thereof. Upon rotation of the threaded member to raise the nut in the direction of the deck, the wedge nut engages the retainer member and causes the foot portions of each leg to engage the underside of the deck to clamp the faucet or end body to the deck.

13 Claims, 6 Drawing Sheets

QUICK INSTALL FAUCET BODY

BACKGROUND OF THE INVENTION

Field of the Invention

The present invention relates generally to a faucet assembly, and more particularly, to a quick install faucet assembly which can be mounted from the top of a deck to which the faucet assembly is connected.

BACKGROUND AND SUMMARY OF THE INVENTION

In conventional faucet assemblies, the mounting of the faucet assembly is completed from, or requires assembly components to be installed from the underside of the deck to which the faucet assembly is mounted. The assembly which is typically required to be performed from the underside of the deck is often awkward and uncomfortable for the installer.

It is an object of the present invention to provide a quick install faucet assembly that is mounted to the deck from above the deck, and that is simple in construction, economical to produce, and highly reliable in operation. It is another object of the present invention to provide a quick install faucet assembly that is easy to assemble or disassemble, as desired. It is still another object of the present invention to provide a quick install faucet assembly for mounting the spout and/or the end bodies of the faucet from above the deck in a quick and easy manner with a minimum of tools or operations.

Accordingly, the present invention provides a quick install faucet assembly, and more specifically, a faucet assembly that is mounted from the top of the deck to which the faucet assembly is connected.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

With reference to the accompanying drawings, the quick install faucet assembly according to the principles of the present invention will be described The quick install faucet assembly described herein includes a spout 10 and a pair of separately mounted end body valve assemblies 12, 14. However, it should be understood that the principles of the present invention may also be applied to a faucet assembly having the spout 10 and valve assemblies 12, 14 as a single unit.

Figure 6:
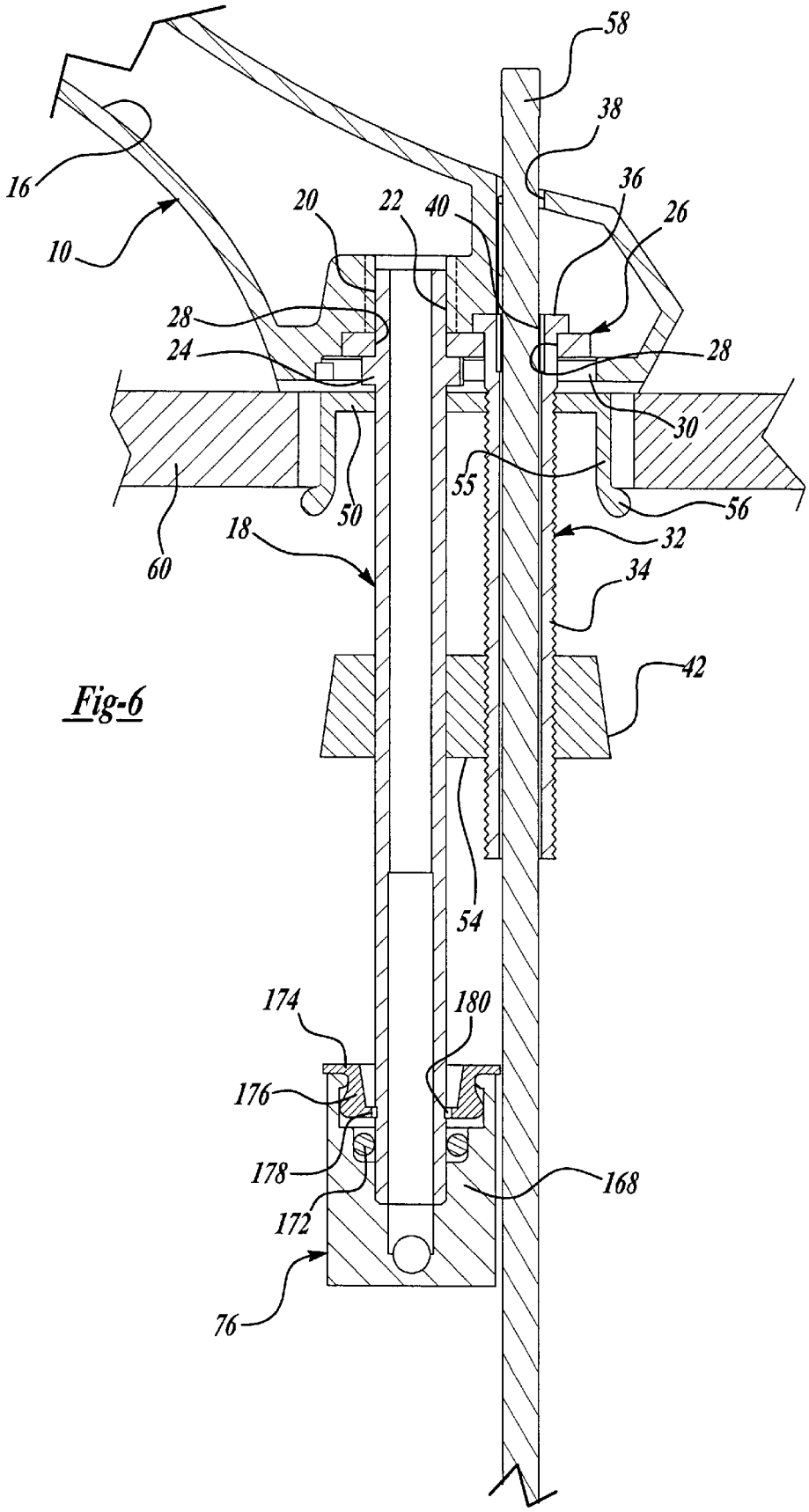
FIG. 6 is a cross-sectional view of the quick install spout assembly according to the principles of the present invention.

As shown in FIG. 6, the spout 10 includes a water passage 16 which communicates with a waterway tube 18. The waterway tube 18 has a threaded end portion 20 which engages an internally threaded portion 22 of the spout 10. The waterway tube 18 includes a radially extending hexagonal flange portion 24. A guide bracket 26 is provided with a pair of openings 28 and receives the threaded portion 20 of the waterway tube 18 through one of the openings 28. The radially extending flange portion 24 supports the guide bracket 26 within a lower cavity 30 defined within the spout 10. The threaded portion 20 of waterway tube 18 is engaged with the internally threaded portion 22 of spout 10. As is known in the art, a Teflon® tape, thread sealant or other seal means, can be provided on the threaded portion 20 of the waterway tube 18 in order to provide a water sealed fit.

A threaded rod 32 is provided with a hollow cylindrical body 34 which is externally threaded and is provided with an upper radially extending flange 36. The threaded rod 32 extends through the second opening 28 in guide bracket 26 while flange 36 rests against the guide bracket 26. The threaded rod 32 is aligned with an opening 38 in the spout 10 which allows access of an allen wrench for engaging an internal hexagonal engagement portion 40 provided in the upper portion of the threaded rod 32. In the completed faucet assembly, a pop-up rod 58 extends through the central opening of the threaded rod 32 and through the opening 38 in spout 10. As is well known in the art, the pop-up rod 58 engages a drain stopper assembly (not shown) for opening and closing the drain stopper.

Figure 5:
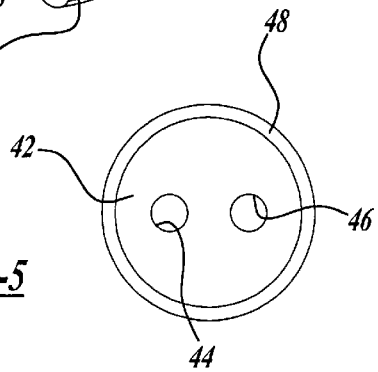
FIG. 5 is a plan view of the wedge nut, according to the principles of the present invention.

A wedge retainer assembly is provided for securing the faucet 10 to a deck or mounting surface 60. The wedge retainer assembly includes a wedge nut member 42 which is threadedly engaged with the threaded rod 32. As best shown in FIG. 5, the wedge nut member 42 includes a threaded opening 44 which engages the threaded rod 32 and a second opening 46 which slidably receives the waterway tube 18. The nut member 42 includes a wedge or cone shaped sidewall 48. A retainer member 50 is slidably mounted to the waterway tube 18 and threaded rod 32. The retainer member 50 includes a base portion 52 having a pair of holes 54 adapted to receive the waterway tube 18 and threaded rod 32. The retainer member 50 includes a plurality of legs 55 each provided with a radially outwardly extending foot portion 56.

Figure 2:
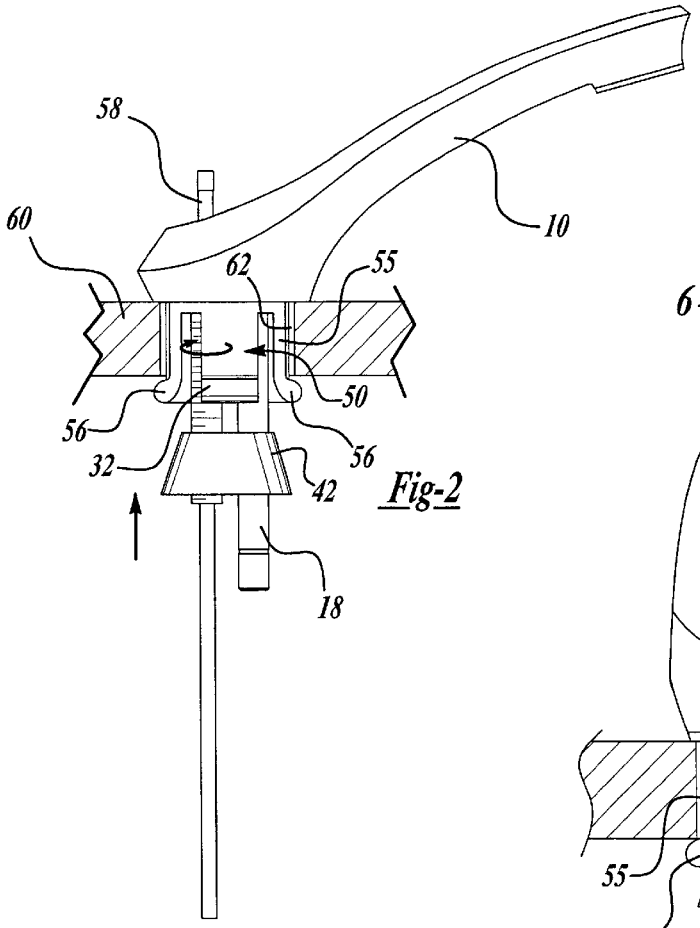
FIG. 2 is a side view of the spout assembly inserted in an opening in the deck with the wedged retainer in the disengaged position, according to the principles of the present invention.
Figure 3:
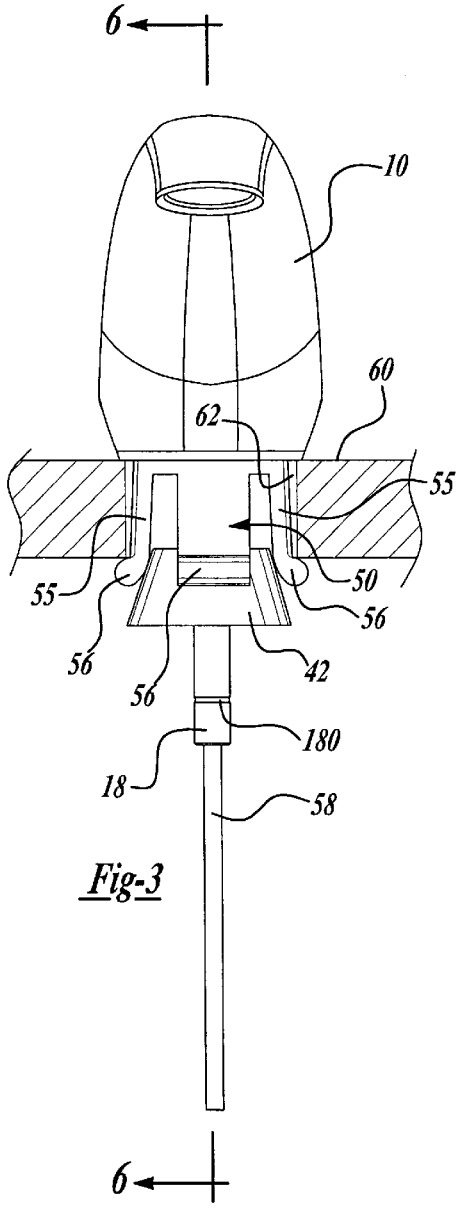
FIG. 3 is a front view of the spout assembly with the wedged retainer in the engaged position for engaging the deck, according to the principles of the present invention.
Figure 4:
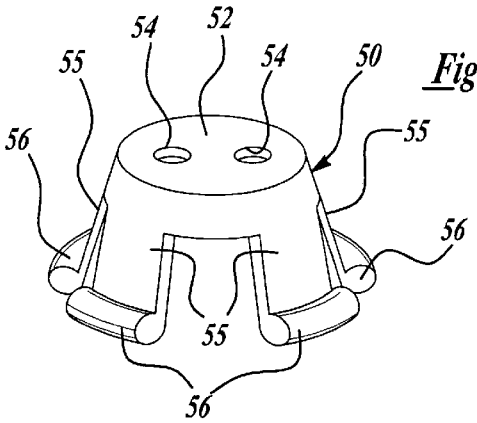
FIG. 4 is a perspective view of the retainer member according to the principles of the present invention.

With reference to FIGS. 2 and 3, the installation of the spout 10 according to the principles of the present invention will now be described. The spout 10 is mounted to a deck or mounting surface 60 which is provided with an opening 62 for receiving the threaded rod 32 and waterway tube 18 of the spout assembly. As shown in FIG. 2, the retainer member 50 is slidably received over the waterway tube 18 and threaded rod 32. The wedge nut member 42 is threadedly engaged with the threaded rod 32 and receives the waterway tube 18 in the second opening 46. The wedge nut member 42 passes through the opening 62 in the deck 60 and the retainer member 50 is disposed above the wedge nut member 42. The spout is then rotated to the final position such that the threaded rod 32 and waterway tube 18 extend generally vertically and the spout 10 is properly aligned with the sink. At this point, an allen wrench can be inserted through the opening 38 in the spout 10 to engage the hexagonal portion 40 of the threaded rod 32. The threaded rod 32 can then be turned in order to draw the wedge nut member 42 and retainer member 50 in an upward direction so that the end portions of the legs 55 of the retainer member 50 are engaged by the wedge nut member 50. As the wedge nut member is drawn further upward by rotation of the threaded rod 32, the foot portions 56 of the legs 55 engage the underside of the deck 60 at four points spaced about opening 62 to secure the spout in place, as best shown in FIG. 3. The pop-rod 58 is slidably received in the opening in the threaded rod 32 and can be easily removed so that the allen wrench can be inserted through the opening 38 of spout 10 to engage the hexagonal portion 48 of the threaded rod 32.

Figure 1:
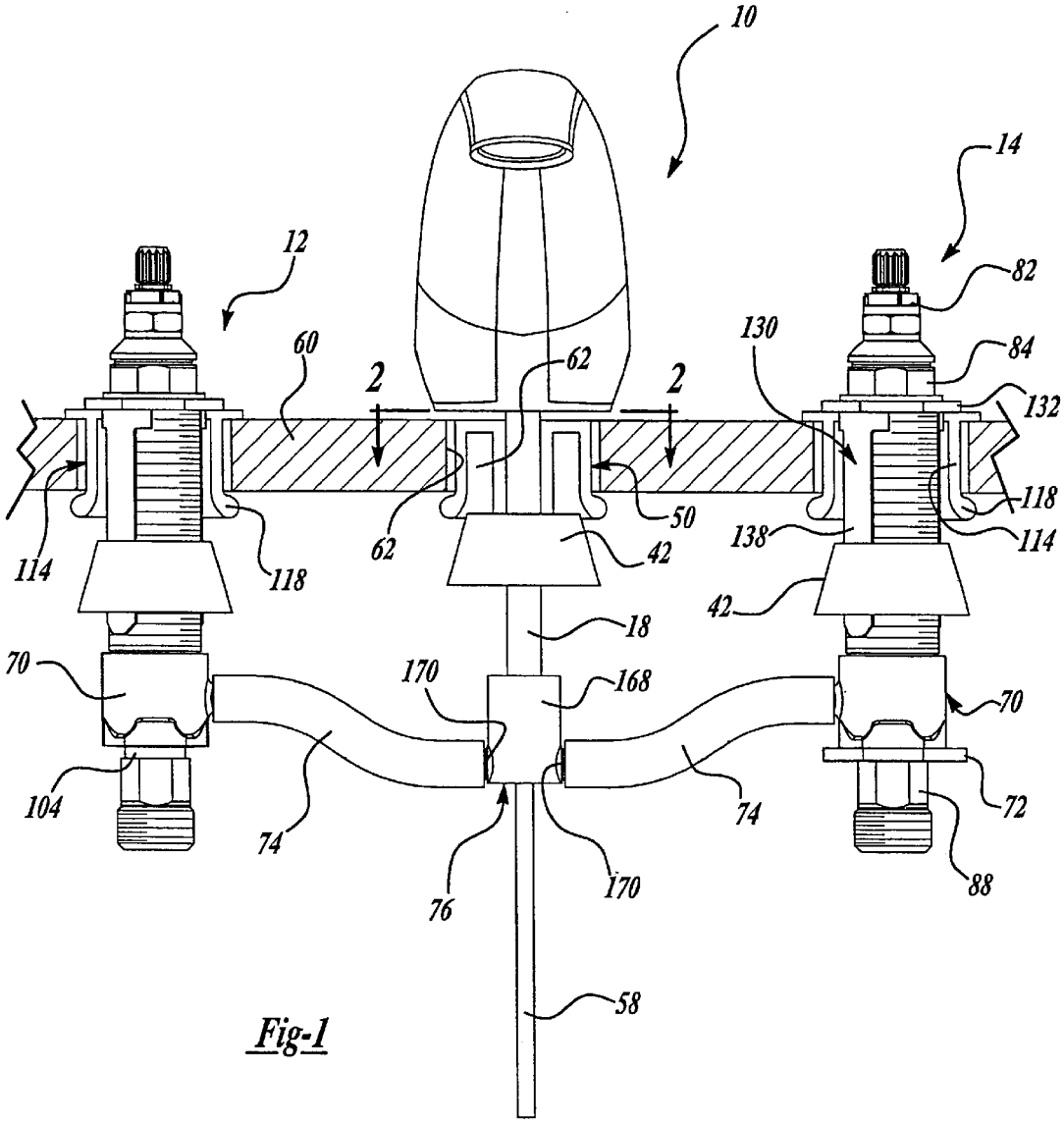
FIG. 1 is a front view of the quick install faucet assembly according to the principles of the present invention.

As shown in FIG. 1, the quick install faucet assembly of the present invention is provided with first and second end body valve assemblies 12, 14. One of the end body valve assemblies 12 is provided for the hot water line while the other of the end body valve assemblies 14 is for the cold water supply line. Each end body valve assembly 12, 14 is provided with an end connector 70, secured in place by a connector clip 72, for communicating water via interconnecting hoses 74 to the T-joint connector 76 mounted to the waterway tube 18 of spout assembly 10.

Figure 12:
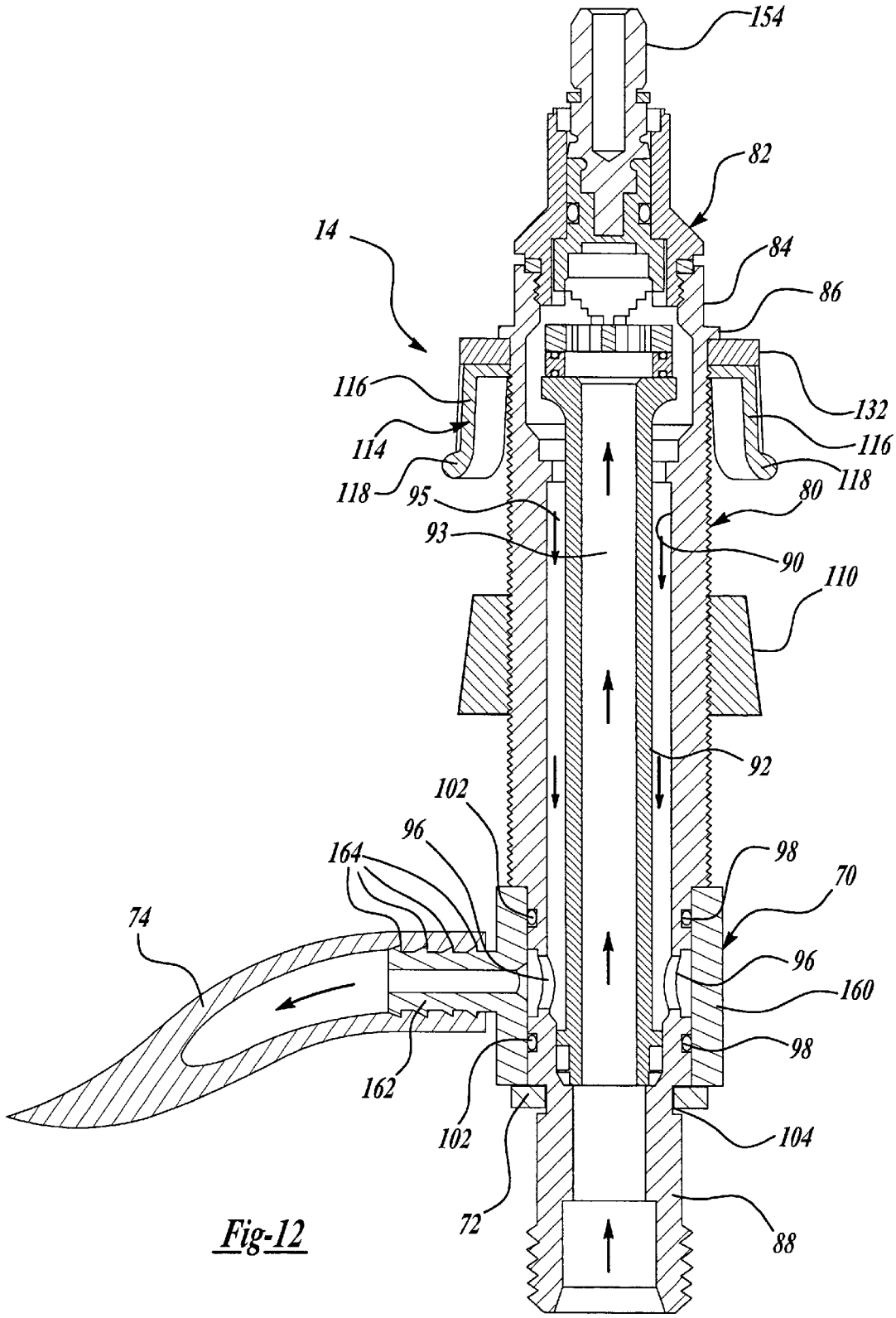
FIG. 12 is a cross-sectional view of the end body valve assembly according to the principles of the present invention.
Figure 13:
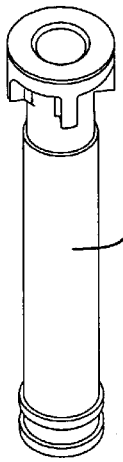
FIG. 13 is a perspective view of the spacer tube for use with the end body valve assembly according to the principles of the present invention.

With reference to FIG. 12, end body valve assembly 14 will be described. It should be understood that the end body valve assemblies 12, 14 have identical configurations and that a separate detailed description of each valve assembly is unnecessary. The end body valve assembly 14 includes a threaded body 80 mounted to a shut-off valve 82. The threaded body 80 includes an upper hexagonal head portion 84 provided with a radially extending flange 86 below the hexagonal head portion 84. The threaded body 80 also includes a hollow longitudinally extending base portion 88 which defines the waterflow path as best shown in FIG. 12. The threaded body 80 has a hollow central portion 90 which receives a spacer tube 92 (shown in FIG. 13). Spacer tube 92 has a hollow opening therethrough which defines the central flowpath 93 which communicates fluid through the shut-off-valve 82. The shut-off valve 82 communicates water from the waterflow path 93 to a concentrically formed waterflow path 95 between the threaded body 80 and spacer tube 92 to communicate water to radially extending openings 96 in the base portion 88 of the threaded body 80. The openings 96 communicate with the end connector 70 for communicating water through the interconnecting hose 74. The base portion 88 of threaded body 80 is provided with radial grooves 98 for supporting O-rings 102 between the base portion 88 and the end connector 70 for providing a water-tight fit between the end connector 70 and the threaded body 80. The base portion 88 of the threaded body 80 includes a recessed area between the O-rings 102 for water flow. The base portion 88 also includes a groove 104 for receiving a retaining clip 72, as shown in FIGS. 1 and 12.

Figure 9:
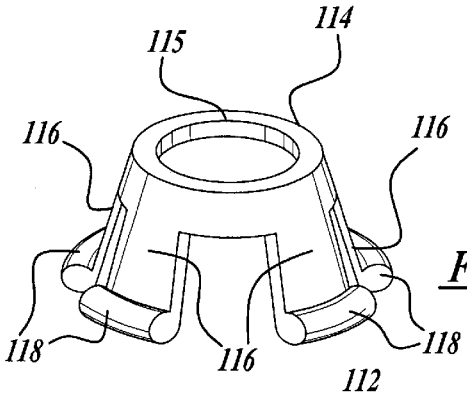
FIG. 9 is a perspective view of the retainer member according to the principles of the present invention.
Figure 10:
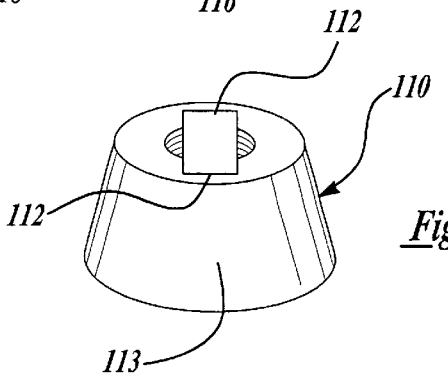
FIG. 10 is a perspective view of the wedge nut according to the principles of the present invention.
Figure 11:
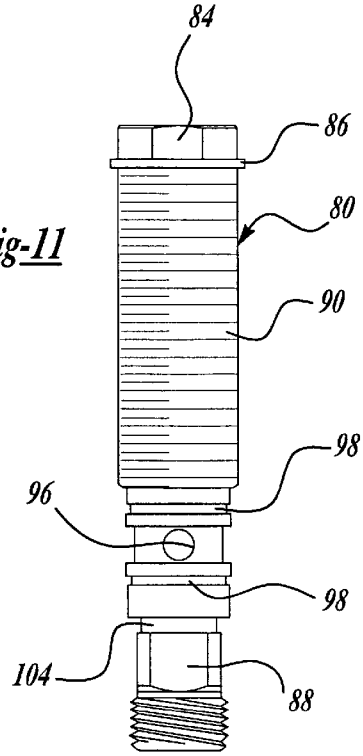
FIG. 11 is a side view of the threaded body for use with the end body valve assembly according to the principles of the present invention.

A wedge retainer assembly is provided for securing the end body valve assembly 14 to a deck or mounting surface 60. The wedge retainer assembly includes a threaded wedge nut 110 which is threadedly engaged with the threaded body 80. Threaded wedge nut 110, as best shown in FIG. 10, is provided with a pair of oppositely disposed guide grooves 112 and a wedge or cone shaped sidewall surface 113. The wedge retainer assembly also includes a retainer member 114. The retainer member 114, as best shown in FIG. 9 includes a central opening 115 for receiving the threaded body 80 and a plurality of legs 116. Each of the legs 116 is provided with a radially outwardly extending foot portion 118.

Figure 14:
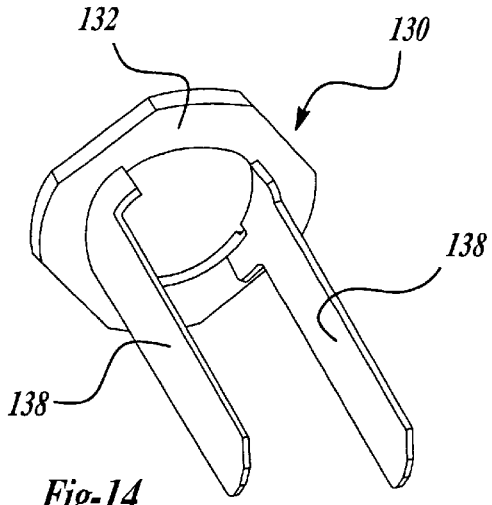
FIG. 14 is a perspective view of the nut guide assembly for use with the end body valve assembly according to the principles of the present invention.
Figure 15:
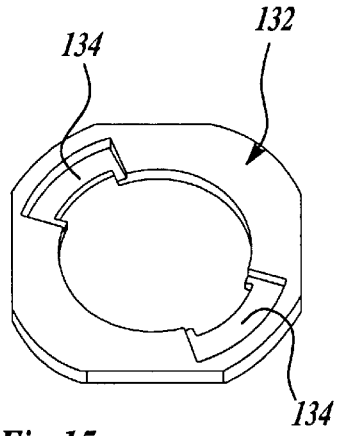
FIG. 15 is a perspective view of the guide flange of the nut guide assembly according to the principles of the present invention.
Figure 16:
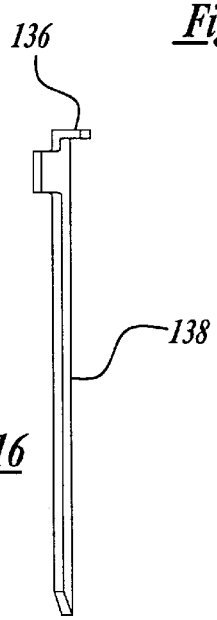
FIGS. 16 and 17 show side and front views, respectively, of the guide arm of the nut guide assembly according to the principles of the present invention.
Figure 17:
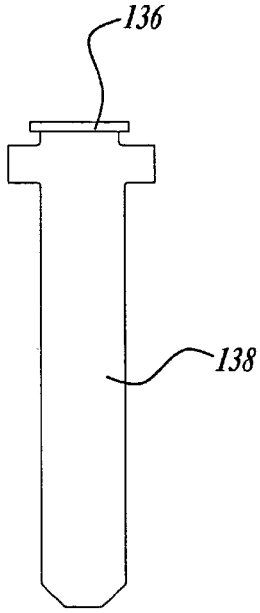

A nut guide assembly 130, as best shown in FIG. 14, is provided for guiding the threaded wedge nut 110 and preventing rotation of the threaded nut 110. The nut guide assembly 130 includes a guide flange 132 which abuts against the radially extending flange 86 of threaded body 80. As best shown in FIG. 15, guide flange 132 includes a pair of recesses 134 which mate with an upper bend portion 136 of oppositely disposed guide arms 138, as best shown in FIGS. 16 and 17. As the guide flange 132 rests against the radially extending flange 86, the flange 86 helps to hold the upper bend portion 136 of the arms 138 in the recesses 134. The guide arms 138 extend through the guide recesses 112 in the threaded wedge nut 110 to prevent the threaded wedge nut 110 from rotating relative to the nut guide assembly 130. Accordingly, as the threaded body 80 is rotated, the wedge threaded nut 110 is prevented from rotating relative to the nut guide assembly 130 therefore causing the threaded wedge nut 110 to move upward and downward along the threaded body 80 depending upon the direction of rotation of the threaded body 80. As the threaded wedge nut 110 moves upward along the threaded body 80 upon rotation of the threaded body 80, the threaded wedge nut 110 engages the legs 116 of the retainer member.

Figure 7:
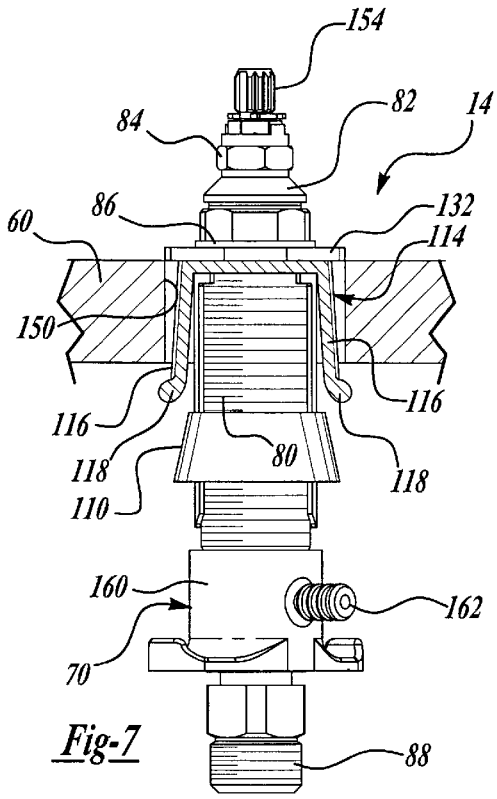
FIG. 7 is a side view of the end body valve assembly inserted in an opening in a deck and with the wedged retainer assembly in the disengaged position according to the principles of the present invention.

During installation of the end body valve assembly 14, according to the principles of the present invention, the threaded body 80 and wedge nut member 1 10 of the end body valve assembly 14 is inserted through an opening 150 in the deck or mounting surface 60, as best shown in FIG. 7.

Figure 8:
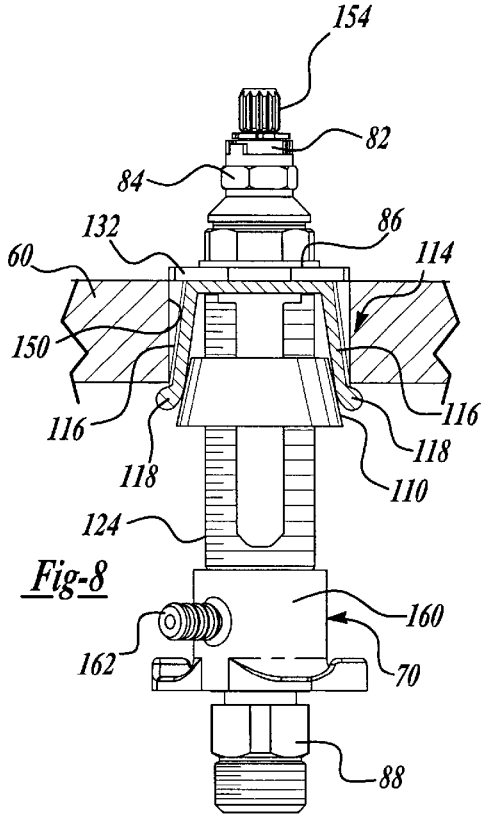
FIG. 8 is a second side view of the end body valve assembly with the wedged retainer assembly in the engaged position according to the principles of the present invention.

In order to securely fasten the end body valve assembly 14 to the deck 60, the guide flange 132 is held and the threaded body 80 is rotated in a clockwise direction in order to draw the threaded nut wedge 110 upward against the legs 116 of the retainer member 114. As the threaded nut wedge 110 spreads the legs 116 of the retainer member 114, the foot portions I 18 of each of the legs 116 engages the underside of the deck 60 in order to secure the end body valve assembly 14 to the deck 60, as best shown in FIG. 8. A wrench can be used to engage the hexagonal head portion 84 of the threaded body 80 in order to tighten the end body valve assembly 14 in place. The height is automatically set for proper handle height. A lever handle (not shown) would then be applied to the upper splined portion 154 of the valve 82 as is known in the art.

At this time, the end connector 70 is attached to the end body valve assembly 14 by sliding the connector 70 over the base portion 88 of the threaded body 80 and the connector clip 72 is inserted in the groove 104 for holding the connector 70 in place. Preferably, the interconnecting hoses 74 are preassembled to the end connectors 70 and T-connector 76, thus reducing the amount of time and work done under the sink where space is limited. The end connector 70, as best shown in FIG. 12, includes a generally cylindrical body portion 160 having a radially extending port neck 162 extending therefrom. Port neck 162 includes serrations 164 on an exterior surface thereof. The serrations 164 engage with the hose 74 to secure the hose 74 to the end connector 70. As an alternative, the hoses 74 can be secured in place by other known fastening methods such as a crimped fitting.

The T-connector 76, shown in FIGS. 1 and 6, includes a body portion 168, as best shown in FIG. 7, connected to the waterway tube 18 and further having first and second hose connector portions 170 for connecting with the hoses 74. The body portion 168, as shown in FIG. 6, supports an O-ring 172 which surrounds the waterway tube 18 as well as a connector ring 174. The connector ring 174 includes a plurality of fingers 176 which extend longitudinally and are provided with radially inwardly extending end portions 178. The radially inwardly extending end portions 178 engage an annular groove 180 formed in the exterior surface of the waterway tube 18 in order to secure the T-connector 76, as best shown in FIG. 1, to the waterway tube 18. The T-connector 76 is commercially available from the PARFLEX Division of Parker Hannifin, 1300 N. Freedom Street, Ravenna, Ohio 44266. As an alternative, other known connectors can be utilized.

The quick connect faucet assembly, according to the principles of the present invention, provides an installation which is much faster than conventional faucets. Furthermore, installation is simplified since all components are tightened from above the sink.

The quick install faucet assembly of the present invention has no loose parts that can be misplaced. The end body and spout can be preassembled and ready for installation by the user.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for installing a fixture on a top side of a deck having at least one mounting hole therein, comprising:

a threaded member engaged with the fixture and extending through the mounting hole to be rotated from above the deck;

a retainer member received around said threaded member;

a wedge nut threadedly connected to the threaded member to pass through the mounting hole to the underside of the deck;

a second member associated with and parallel to the threaded member, the second member engaging the wedge nut to prevent rotation thereof during rotation of the threaded member whereby the wedge nut will be shifted up or down along the length of the threaded member responsive to the direction of rotation of the threaded member;

wherein upon rotation of the threaded member to raise the wedge nut in the direction of the deck, the wedge nut engages said retainer member and causes a portion of said retainer member to engage the underside of the deck to clamp the fixture to the deck.

2. The apparatus according to claim 1, wherein the retainer member includes at least one leg having a foot portion at an end thereof that engages the underside of the deck when the wedge nut is moved in the upward direction and engages the retainer member.

3. The apparatus according to claim 1, wherein the retainer member includes a plurality of legs each having a foot portion at an end thereof that engages the underside of the deck when the wedge nut is moved in the upward direction and engages the retainer member.

4. The apparatus according to claim 1, wherein the second member includes a top disc journaled to the threaded member and at least one guide arm connected to the top disc which extends parallel to the threaded member.

5. The apparatus according to claim 4, wherein said wedge nut has a recess through which the guide arm extends to prevent the wedge nut from rotating during rotation of the threaded member whereby the wedge nut will be caused to be shifted toward or away from the deck upon rotation of the threaded member.

6. The apparatus according to claim 1, wherein the second member defines a waterway to the fixture.

7. The apparatus according to claim 1, wherein:

the fixture defines a spout;

the second member threadedly engages the spout;

a connecting plate is provided including a pair of holes one through which the second member passes and the other through which the threaded member passes;

the connecting plate non-movably clamped to the spout by the second member;

the threaded member having an enlarged head which sits atop the plate and which is turnable therein to raise or lower the wedge nut thereon.

8. The apparatus according to claim 1, wherein:

the fixture defines an end body having a valve therein.

9. A faucet configured to be mounted to a deck, the deck including an opening, the faucet comprising:

a spout having a passage therein;

a tube connected to said spout for delivering water to said passage;

a threaded rod rotatably connected to said spout;

a nut member having a threaded opening for engaging said threaded rod and means for engaging the tube;

a retainer member including at least one leg and disposed around said threaded rod and, operatively, at least partially disposed in the opening, wherein upon rotation of said threaded rod, said nut member moves upward relative to said spout and causes said at least one leg of said retainer member to engage an underside of a mounting surface for securely mounting said spout to said mounting surface.

10. The faucet according to claim 9, wherein said spout includes an opening in a top portion thereof for accessing a tool engaging portion of said threaded rod.

11. The faucet according to claim 10, wherein said opening in said top portion of said spout is provided for receiving a pop-up rod for engaging a drain stopper device.

12. The faucet according to claim 9, wherein said retainer member includes a plurality of legs each provided with a foot portion at an end thereof, said foot portions adapted to engage the underside of the mounting surface.

13. The faucet according to claim 9, further comprising a pair of end body valve assemblies each including:

a threaded body mounted to a shut-off valve;

a wedge nut member threadedly engaging said threaded body; and a retainer member disposed around said threaded body and including at least one leg, wherein upon rotation of said threaded body said wedge nut member moves relative to said threaded body and causes said at least one leg of said retainer member to engage an underside of a mounting surface for securely mounting said end body valve assemblies to said mounting surface.

* * * * *

UNITED STATES PATENT AND TRADEMARK OFFICE

CERTIFICATE OF CORRECTION

PATENT NO. : 6,405,749 B1 
DATED : June 18, 2002
INVENTOR(S) : Mark S. Bloom et al.

It is certified that error appears in the above-identified patent and that said Letters Patent is hereby corrected as shown below:

Title page,
Item [56], References Cited, U.S PATENT DOCUMENTS, insert the following:
-- 809,720 1/1906 Mueller
810,168 1/1906 Mueller
753,974 3/1904 Glauber --

Signed and Sealed this

Thirtieth Day of December, 2003

JAMES E. ROGAN
*Director of the United States Patent and Trademark Office*